United States Patent [19]

Bond, Sr.

[11] Patent Number: 4,953,770

[45] Date of Patent: Sep. 4, 1990

[54] POOL CUE CHALK HOLDER

[76] Inventor: Thomas Bond, Sr., 16885 McGregor Blvd., Fort Myers, Fla. 33908

[21] Appl. No.: 301,520

[22] Filed: Jan. 24, 1989

[51] Int. Cl.[5] ..... A45F 3/14; A63D 15/16

[52] U.S. Cl. ..... 224/250; 224/252; 224/901; 224/904; 273/18; 30/494

[58] Field of Search ..... 224/25 D, 252, 901, 224/251, 904; 273/17-21, 14, 2; 30/494; 24/3 L, 3 K; 81/177.7, 3.08

[56] References Cited

U.S. PATENT DOCUMENTS

| | | | |
|---|---|---|---|
| 744,935 | 11/1903 | Pajchar | 273/18 |
| 1,473,361 | 1/1922 | Tebbetts | 24/3 L |
| 1,497,346 | 6/1924 | Peterson | 24/3 K |
| 4,060,243 | 11/1977 | Langan | 273/18 |
| 4,220,302 | 9/1980 | Hampton et al. | 224/901 |
| 4,403,366 | 9/1983 | Lucke | 224/901 |

*Primary Examiner*—Linda J. Sholl

*Attorney, Agent, or Firm*—William E. Noonan

[57] ABSTRACT

A pool cue chalk holder is disclosed including a clip that is selectively attachable to an article of clothing and complementary first and second hook and loop fastening elements. The first and second fastening elements are secured respectively to the clip and to a pool cue chalk and are selectively engageable with each other to detachably fasten the chalk to the clip.

7 Claims, 2 Drawing Sheets

POOL CUE CHALK HOLDER

FIELD OF THE INVENTION

This invention relates to a holder for a conventional billiard or pool cue chalk.

BACKGROUND OF THE INVENTION

Virtually all pool and billiard players use conventional cue chalks to apply chalk to the tips of their cue sticks between shots. Storing or holding the block or cube of chalk between successive shots is very often annoying and inconvenient. Typically, the cube is left on the side of the table or elsewhere about the room. Because the players and the chalk are constantly moving about the table, the chalk may not be readily accessible for the next shot and the game may be delayed. The chalk may even be misplaced or lost. Storing the cube in one's pocket is impractical because the chalk tends to be fairly messy.

Additional problems are created by players sharing chalk cubes. A player may leave sweat or saliva on the cube, thereby rendering it useless for his partner or opponent. Accordingly, each player should have his own chalk and the chalk should be immediately accessible to him.

In an attempt to meet this need, various ring-type holders have been provided for cue chalk cubes. These holders have been designed typically to support the cube on one of the fingers of the player's guide hand during his shot. However, such holders are often awkward and clumsy to wear and may interfere with the movement of the cue stick. Pool and billiards are games requiring a high degree of "feel" and ring holders may disrupt that feel. Moreover, such holders are totally impractical for players who operate and chalk the cue stick with the same hand. For example, a right handed pool player will typically wear the ring holder on his left hand that rests on the table to support the cue during the shot. However, most right handed players tend to chalk the cue using their right hands. As a result, chalking is made awkward; either the ring must be switched to the opposite hand or chalking must be performed with the less natural hand.

SUMMARY OF THE INVENTION

It is therefore an object of this invention to provide a pool or billiards cue chalk holder that allows the player ready access to a personal chalk cube after each shot.

It is a further object of this invention to provide a chalk holder that provides for quick, secure mounting and storage of the chalk cube after each use so that fewer chalk cubes are misplaced and soiling of the user's clothing is reduced.

It is a further object of this invention to provide a chalk holder that does not interfere with operation or feel of the cue stick and which provides ready, convenient access to the chalk after each shot so as not to interfere with concentration or break the players momentum once it begins.

It is a further object of this invention to provide a chalk holder that may be conveniently re-used with various sized replacement chalk cubes.

It is a further object of this invention to provide a chalk holder that readily attaches to the user's clothing.

It is a further object of this invention to provide a chalk holder that carries various other pool and billiard accessories in a convenient folding manner.

This invention results from a realization that a need exists for an improved pool or billiard cue chalk holder that provides for quick, secure and convenient mounting of the cube, and at the same time, ready access to and quick, easy removal of the cube when chalk is required. This may be achieved by employing complementary hook and loop fastening means on a mounting clip and the chalk cube This invention results from the further realization that by holding the cube on a clip that is attached to the user's clothing, the chalk creates much less of a mess and does not interfere with the grip, feel or operation of the cue stick. The player's momentum and concentration are not hindered, thereby improving the player's overall game.

These benefits are accomplished by the present invention which features a pool cue chalk holder, including a clip that is selectively attachable to an article of clothing. There are complementary first and second hook and loop (i.e. Velcro) fastening elements and means are provided for securing the first and second fastening elements respectively to the clip and to the pool cue chalk. The first and second fastening elements are selectively engageable with each other to detachably fasten the chalk to the clip.

In a preferred embodiment, the clip includes an elongate inner member that is engageable with an inner surface of the article of clothing and an elongate outer member that is interconnected with the inner member and extendable over an outer surface of the article of clothing. The clip may further include spring means for urging the inner and outer members toward each other. The clip may have a generally U-shaped cross section.

The second fastening element may include an elastic portion that is wrappable about the pool cue chalk and adjustable in size to accommodate various sizes of chalk. The means for securing may include means for releasably securing the second fastening element to the cue chalk. Such means for releasably securing may include a releasable fastening portion that is attached to a first end of the second fastening element and has one of a hook and loop surface that complements the second fastening element and is selectively engageable with a second end of the second fastening element to secure the second fastening element to the chalk. The means for securing may also include adhesive for securing the first fastening element to the clip.

The clip may further include pivot means for mounting a pool cue appliance, such as a "tip tapper" (i.e. a device to roughen the cue's tip so that the tip is more receptive to the chalk) or a cue tip shaping device, to one of the inner and outer members. In such an embodiment, the appliance may be selectively pivoted between a closed condition in general alignment with the first and second members and an open condition for using the appliance with a pool cue.

BRIEF DESCRIPTION OF THE DRAWINGS

Other objects, features and advantages will occur from the following description of a preferred embodiment and the accompanying drawings in which.

DETAILED DESCRIPTION OF PREFERRED EMBODIMENTS

Figure 1:
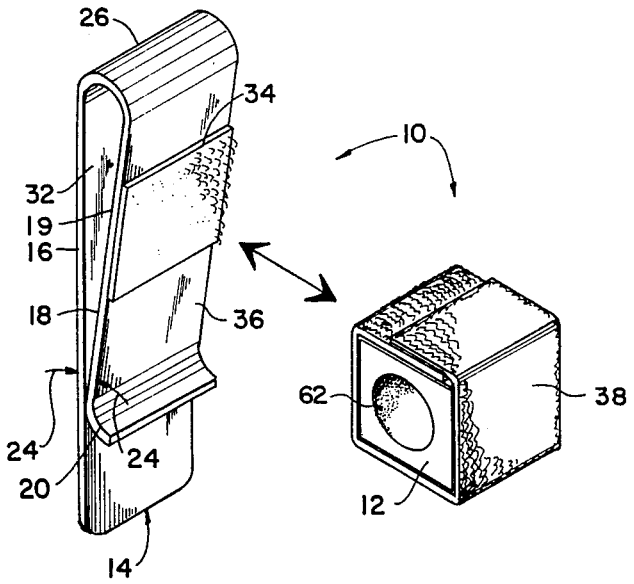
FIG. 1 is a perspective view of the pool cue chalk holder of this invention and the cue chalk for which the holder is used.

There is shown in FIG. 1 a holder 10 for selectively supporting a conventional pool cue chalk cube or block 12. Holder 10 includes a clip 14 that is adapted for attachment to an article of clothing. In particular, clip 14 has a configuration that is generally similar to a money clip. It includes a generally U-shaped cross section. An elongate, generally flat inner member 16 is engageable with an inner surface of the article of clothing and an outer member 18 is interconnected to inner member 16 and has an inside surface 19 that extends over the outer surface of the clothing. Inner member 16 is preferably flat and straight so that it will fit comfortably within the player's trousers or shirt pocket. The lower end of member 18 includes an outwardly flared portion 20. This effectively forms an opening at the lower end of clip 14 that facilitates fitting the clip onto an article of clothing. Clip 14 is preferably composed of a metal or metal alloy, but alternatively may include various types of plastics or other materials. Clip 14 also includes some type of spring means that urge inner and outer members 16 and 18 toward each other in the direction of arrows 24. Such spring means are typically contained in the junction portion 26 that integrally interconnects inner member 16 and outer member 18. In FIG. 1 clip 14 is composed of metal and is configured generally in the form of a leaf spring so that the inner and outer members are urged toward each other. In alternative embodiments a separate coil spring hinge may be utilized to interconnect the inner and outer members.

Figure 2:
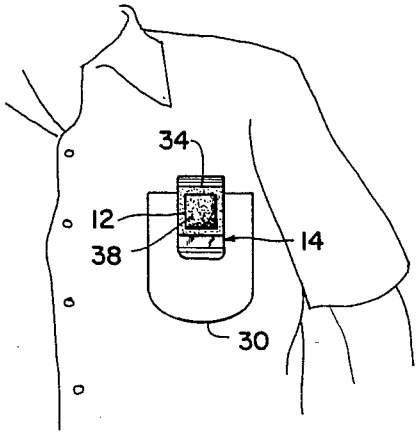
FIG. 2 is a elevational front view of the holder attached to a shirt pocket.

Due to the above construction, clip 14 fits onto an article of clothing as shown in FIG. 2. In particular, flared portion 20 is grasped and outer member 18 is spread apart slightly from inner member 16 so that the article of clothing, for example shirt pocket 30, FIG. 2, fits within the space 32, FIG. 1, formed between the inner and outer members 16 and 18 of clip 14. Clip 14 is therefore slipped onto the shirt pocket and due to the spring means in junction portion 26, the inner and outer members 16 and 18 are urged toward one another to hold the clip 14 in place on pocket 30.

As shown in FIGS. 1 and 2, a first fastening element comprising a strip of hook and loop fastening material commonly known as Velcro, is secured by an adhesive or similar means to the outer surface 36 of outer member 18. In the disclosed embodiment, hook material is employed. However, in alternative embodiments a strip of loop material may be applied to the outer member 18.

A second fastening element 38 comprising a complementary strip of hook and loop fastening material is attached to chalk cube 12. When hook material is used for first element 34, a loop material is employed for fastening element 38. Second fastening element 38 is attached to chalk 12 in the manner shown in FIG. 3. In particular, fastening element 38 includes an elastic base material 40 that has a first end 42 and an opposite second end 44. Loop material 46 is carried along most of the outer surface of elastic base 40. Hook material 50 is carried along the outer surface of second end 44. This hook material may be sewn to or otherwise attached to the loop portion of fastening element 38. To attach fastening element 38 to chalk 12 the first end 42 of the fastening element is engaged with one of the surfaces 52 of chalk cube 12. The fastening element is then wrapped about the four adjoining cube surfaces 52, 54, 56 and 58 of chalk 12. Second end 44 of fastening element 38 is stretched and folded under itself so that the hook material 50 at second end 44 engages the loop material 46 at first end 42. With the two ends in engagement, the fastening element 38 is held in place about chalk cube 12. Because the elastic base 40 is employed, the fastening element 38 may be stretched in the direction of double headed arrow 60. As a result, the length of fastening element 38 may be adjusted to accommodate cubes of various size.

Figure 3:
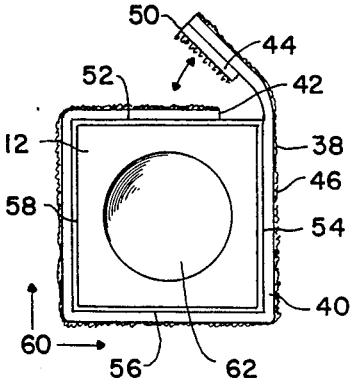
FIG. 3 is an elevational side view of the fastening element that is secured to the chalk cube.

During a game of pool or billiards, the player employs chalk cube 12 with its attached fastening element 38 in a conventional manner to regularly chalk the tip of his cue stick. In particular, the chalk cube is applied to the tip of the stick so that chalk recess 62, FIGS. 1 and 3, is applied to the tip. After chalk has been applied to the tip of the stick, the player mounts the chalk cube 12 to the clip 14 simply by placing the chalk against the clip so that the loop material 46 of fastening element 38 engages the hook material of first fastening element 34. As a result, fastening element 34 holds fastening element 38 and chalk 12 securely to clip 14 during the player's shot.

Figure 4:
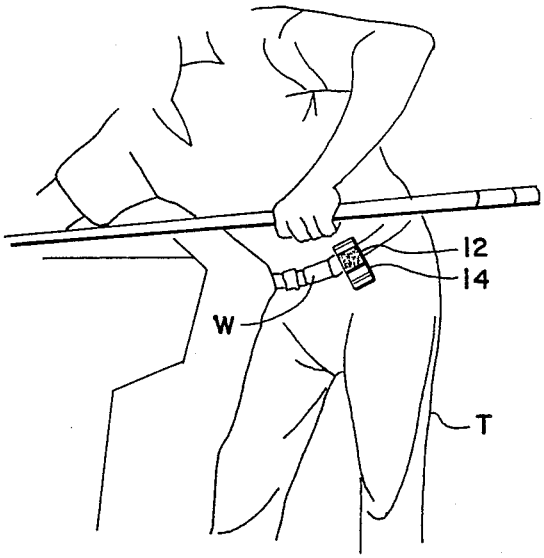
FIG. 4 is a perspective view of a pool or billiards player who has attached the holder to the waist of his trousers.

As shown in FIG. 2, when the clip is worn on a shirt pocket 30 the chalk 12 is held outside of pocket 30. Alternatively, as shown in FIG. 4, clip 14 may be attached to the waist W of the player's trousers T. In this case, the chalk 12 is held outside of the trousers. In either case, the player has immediate access to chalk 12 following his shot. The chalk is quickly and effortlessly removed from clip 14 by pulling it away from the clip so that fastening element 38 disengages fastening element 34 in the manner indicated by the arrows in FIG. 1. The problem of misplaced chalk cubes is reduced and the player's concentration and momentum are not broken in searching for the chalk. Each player has access to his own personal chalk which is not soiled by other players. Additionally, because the clip 14 holds the chalk 12 outside of the player's clothing, messy chalk residue does not collect inside of the player's pockets. Further, as most clearly illustrated in FIGS. 2 and 4, the chalk is held out of the way of the player's hands and fingers and, as a result, the chalk cube does not interfere with the player's shot and an improved feel is provided.

The utilization of hook and loop fastening elements in the holder is particularly advantageous. The effort required to engage other types of fasteners such as buttons and snaps would tend to distract the player, at least momentarily, thereby hindering his game. In contrast, Velcro elements permit the chalk to be effortlessly attached to and removed from the clip without interferring with the player's concentration and momentum. This contributes to the overall improvement of his game.

Figure 5:
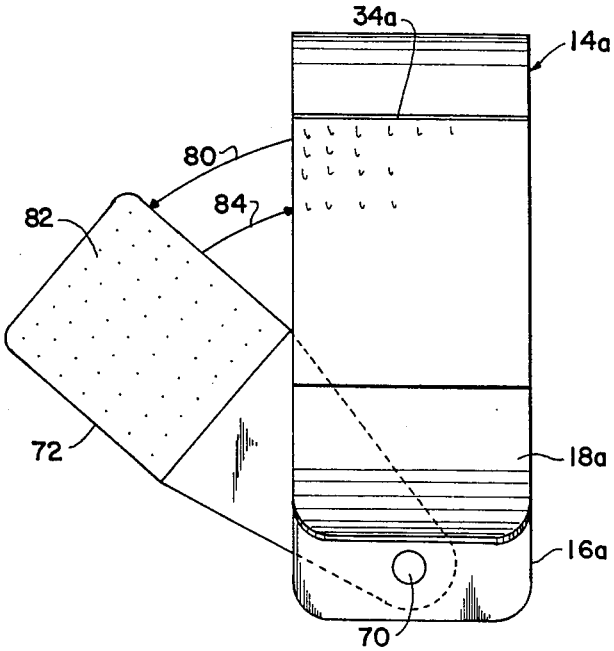
FIG. 5 is an elevational front view of an alternative clip means having a pivotably attached pool or billiards appliance.
Figure 6:
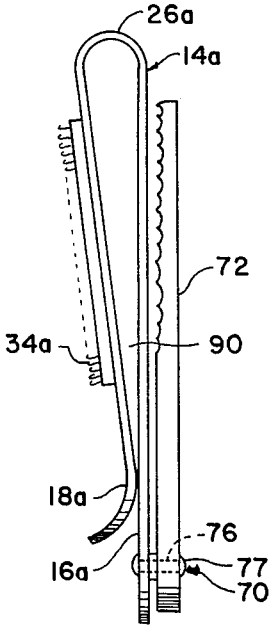
FIG. 6 is a side view of the clip of FIG. 5.

As shown in FIGS. 5 and 6, an alternative clip 14*a* according to this invention may be provided with a hinge or pivot 70 that pivotably mounts a pool or billiard appliance 72 to the inner member 16*a* of clip 14*a*. In the embodiment shown in FIGS. 5 and 6, the appliance is a device for ruffing the leather tip of the cue stick so that the chalk adheres better to the tip. This appliance is commonly referred to as a "tip tapper". In alternative embodiments, a cue stick tip shaper and possibly other pool or billiard appliances may be similarly mounted to the clip of this invention. In FIGS. 5 and 6 the elements of the clip 14*a* are assigned the same numbers as are the analogous elements of clip 14 of the prior embodiment, along with lower case "a" designations.

Clip 14*a* includes a pivot 70 that is permanently secured to inner member 16*a* proximate the lower end of member 16*a*. Pivot 70 may be permanently attached in this manner by various fastening means such as screws, nuts and bolts, welding or riveting. The pivot itself may comprise a rivet. Appliance 72 includes an opening 76, FIG. 6, proximate its pivotal end through which pivot 70 extends. The appliance is then held onto pivot 70 by an enlarged end 77 or alternative attachment means. As a result, appliance 72 is pivotably mounted on pivot 70 with its rough surface facing clip 14*a*. When the player desires to utilize appliance 72, the appliance is pivoted outwardly in the direction of arrow 80, FIG. 5. The player then taps the tip of the cue stick with appliance 72 so that the spikes or barbs 82 on appliance 72 rough the tip of the cue stick in the desired manner. After this operation is completed, appliance 72 is returned to its stored position by folding it in the direction of arrow 84 back into general alignment with inner and outer members 16*a* and 18*a*, as shown in FIG. 6.

In virtually all other respects, the holder shown in FIGS. 5 and 6 operates similarly to the holder shown in FIGS. 1 through 4. The cue chalk, as shown in FIGS. 1 through 4, is selectively attached to the hook material fastening element 34*a*, FIGS. 5 and 6, to hold the chalk cube to the clip 14*a* during the player's shot. The clip 14*a* itself is attached to the player's article of clothing simply by spreading inner and outer members 16*a* and 18*a* slightly apart and sliding the clip 14*a* onto the article of clothing so that the clothing fits between the space 90 formed between outer member 18*a* and inner member 16*a*. The inside face of appliance 72 is smooth so that the appliance slips conveniently with clip 14*a* onto the player's clothing.

Although specific features of the invention are shown in some drawings and not others, this is for convenience only as each feature may be combined with any or all of the other features in accordance with the invention.

Other embodiments will occur to those skilled in the art and are within the following claims.

What is claimed is:

1. A pool cue chalk holder comprising: a clip that is selectively attachable to an article of clothing, said clip including an elongate, generally flat inner member that is engagable with an inner surface of the article of clothing, an elongate outer member having a generally plate-like outer face area and being interconnected with said inner member and extendable over an outer surface of the article of clothing, and spring means for urging said inner and outer members toward each other; and complementary first and second hook and loop fastening elements, said first element including a strip of hook and loop material that is secured to said outer face area of said outer clip member and said second fastening element surrounding and being attachable to a pool cue chalk; said second fastening element having sections engaging at least four sides of said pool cue chalk; at least a portion of each section having complementary hook and loop material attached such that a selected one of at least four sides of said chalk may be placed against said clip causing said second fastening element to engage with said first fastening element to detachably fasten said chalk to said clip.

2. The holder of claim 1 in which said clip includes a generally U-shaped cross section.

3. The holder of claim 1 in which said second fastening element includes an elastic portion that is wrappable about a pool cue chalk and adjustable in size to accommodate various sizes of chalk.

4. The holder of claim 1 in which said means for securing include means for releasably securing said second fastening element to the cue chalk.

5. The holder of claim 1 in which said means for releasably securing include a fastening portion that is attached to a first end of said second fastening element and has one of a hook and loop surface that complements said second fastening element and is selectively engageable with a second end of said second fastening element to secure said second fastening element to said chalk.

6. The holder of claim 1 in which said means for securing include an adhesive for securing said first fastening element to said clip.

7. The holder of claim 1 in which said clip further includes pivot means for mounting a pool cue appliance to one of said inner and outer members such that the appliance may be selectively pivoted between a closed condition located in general alignment with said inner and outer members and an open condition for using the appliance with a pool cue.

* * * * *